US006869032B2

(12) United States Patent
Maier et al.

(10) Patent No.: US 6,869,032 B2
(45) Date of Patent: Mar. 22, 2005

(54) FUEL INJECTION VALVE

(75) Inventors: Martin Maier, Moeglingen (DE); Guenter Dantes, Eberdingen (DE); Detlef Nowak, Untergruppenbach (DE); Joerg Heyse, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/297,155

(22) PCT Filed: Mar. 27, 2002

(86) PCT No.: PCT/DE02/01107

§ 371 (c)(1),
(2), (4) Date: May 16, 2003

(87) PCT Pub. No.: WO02/079637

PCT Pub. Date: Oct. 10, 2002

(65) Prior Publication Data

US 2003/0192965 A1 Oct. 16, 2003

(30) Foreign Application Priority Data

Mar. 31, 2001 (DE) ..... 101 16 186

(51) Int. Cl.[7] ..... F02M 61/00
(52) U.S. Cl. ..... 239/533.13; 239/585.5
(58) Field of Search ..... 239/533.12, 585.4, 239/585.5

(56) References Cited

U.S. PATENT DOCUMENTS 4,971,254 A * 11/1990 Daly et al. ..... 239/489
6,079,642 A * 6/2000 Maier ..... 239/585.1
6,273,349 B1 * 8/2001 Fischbach et al. ..... 239/585.1

FOREIGN PATENT DOCUMENTS

| | | |
|---|---|---|
| DE | 3943005 | 7/1990 |
| DE | 196 07 288 | 10/1996 |
| DE | 198 47 625 | 4/1999 |
| DE | 198 15 789 | 10/1999 |
| EP | 350885 | 1/1990 |
| FR | 2773852 | 7/1999 |
| JP | 11062787 | 6/1999 |
| WO | WO/ 99/53191 | * 10/1999 |

* cited by examiner

*Primary Examiner*—Christopher Kim
(74) *Attorney, Agent, or Firm*—Kenyon & Kenyon

(57) ABSTRACT

A fuel injector, in particular for a high-pressure injector for direct injection of fuel into a combustion chamber of an internal combustion engine, has compression of a fuel/air mixture with spark ignition. On the downstream end of the valve a valve seat element is provided, to which a perforated disk acting as a flow restrictor is connected downstream. A swirl element is situated upstream from the valve seat which imparts an atomization-promoting rotational motion to the fuel to be injected. In the valve seat element downstream from the valve seat, an elongated outlet orifice is provided which opens directly into an orifice in the perforated disk attached to the valve seat element. The width of the outlet orifice is greater than the width of the orifice in the perforated disk, at least at its narrowest location, so that it is possible to adjust the steady-state flow rate of the valve at the orifice.

9 Claims, 2 Drawing Sheets

FUEL INJECTION VALVE

FIELD OF THE INVENTION

The present invention relates to a fuel injectors used in internal combustion engines.

BACKGROUND INFORMATION

An electromagnetically actuatable fuel injector is described in German Patent No. 39 43 005 in which multiple disk-shaped elements are situated in the seat area. When the magnetic circuit is energized, a flat valve plate acting as a flat armature is lifted up from a valve seat plate situated at the opposite end which cooperates with the flat valve plate and together with the flat valve plate forms a plate valve part. A swirl element is situated upstream from the valve seat plate which imparts a circular rotational motion to the fuel flowing to the valve seat. A stop plate delimits the axial path of the valve plate at the opposite end from the valve seat plate. The valve plate is enclosed by the swirl element with a large amount of leeway and thus the swirl element guides the valve plate. Multiple tangentially running grooves are provided in the swirl element on its lower front face which extend from the outer periphery into a center swirl chamber. When the swirl element rests with its lower front face on the valve seat plate, the grooves act as swirl channels. The spray-discharge orifice provided in the valve seat plate determines the spray-discharge geometry via its length and diameter, and therefore must be introduced with great precision.

In addition, a fuel injector is described in European Patent Application No. 350 885 in which a valve seat body is provided, and a valve closing body which is situated on an axially movable valve needle cooperates with a valve seat face of the valve seat body. In a recess in the valve seat body upstream from the valve seat face a swirl element is situated which imparts a circular rotational motion to the fuel flowing to the valve seat. A stop plate delimits the axial path of the valve needle and has a central orifice which provides a certain guiding of the valve needle. Multiple tangentially running grooves are provided in the swirl element on its lower front face which extend from the outer periphery into a center swirl chamber. When the swirl element rests with its lower front face on the valve seat body, the grooves act as swirl channels. In this fuel injector as well, the size of the spray-discharge orifice provided in the valve seat body determines the spray-discharge geometry, so that this spray-discharge orifice must also be shaped very precisely.

The multilayer metal plating technique for manufacturing perforated disks which are particularly suited for use in fuel injectors has been described in detail in German Patent Application No. 196 07 288. This principle for manufacturing disks by single or multiple metal electrodeposition of various layered structures to produce a one-piece disk is expressly incorporated by reference herein.

SUMMARY

The fuel injector according to the present invention has the advantage that it is particularly simple and inexpensive to manufacture. The perforated disk provided on the valve seat element may be easily and securely mounted. Perforated disks having simple and yet very different orifice structures may be manufactured on a large scale very easily and in a precisely reproducible manner. The perforated disks are components which are easily handled in manufacturing and fine machining operations. Since in the perforated disks according to the present invention the flow-determining orifice cross section is provided with a flow restriction function, it is has the advantage that no high demands are placed on the dimensional accuracy of the outlet opening in the valve seat element downstream from the valve seat face. The valve seat element is therefore considerably easier to handle during manufacturing and machining.

The steady-state flow rate of the valve may be adjusted using the perforated disk which acts as a flow restrictor and which may be easily manufactured, handled, and installed.

It is particularly advantageous to design the perforated disk with an orifice which is stepped or otherwise modified in its cross section. The narrowest section of the orifice then determines the steady-state flow rate, while it is possible for the remaining length of the orifice to influence the spray angle of the spray-discharged fuel.

If the perforated disk is manufactured by metal electrodeposition, for example, any desired orifice cross section may be provided very easily, thus making it possible for the shape of the jet to have an extremely variable design.

In the absence of high demands on the dimensional accuracy of the outlet in the valve seat element, the steady-state flow rate, the spray angle, and the shape of the jet may be adjusted very easily by the precise orifice contour of the perforated disk.

DETAILED DESCRIPTION

Figure 1:
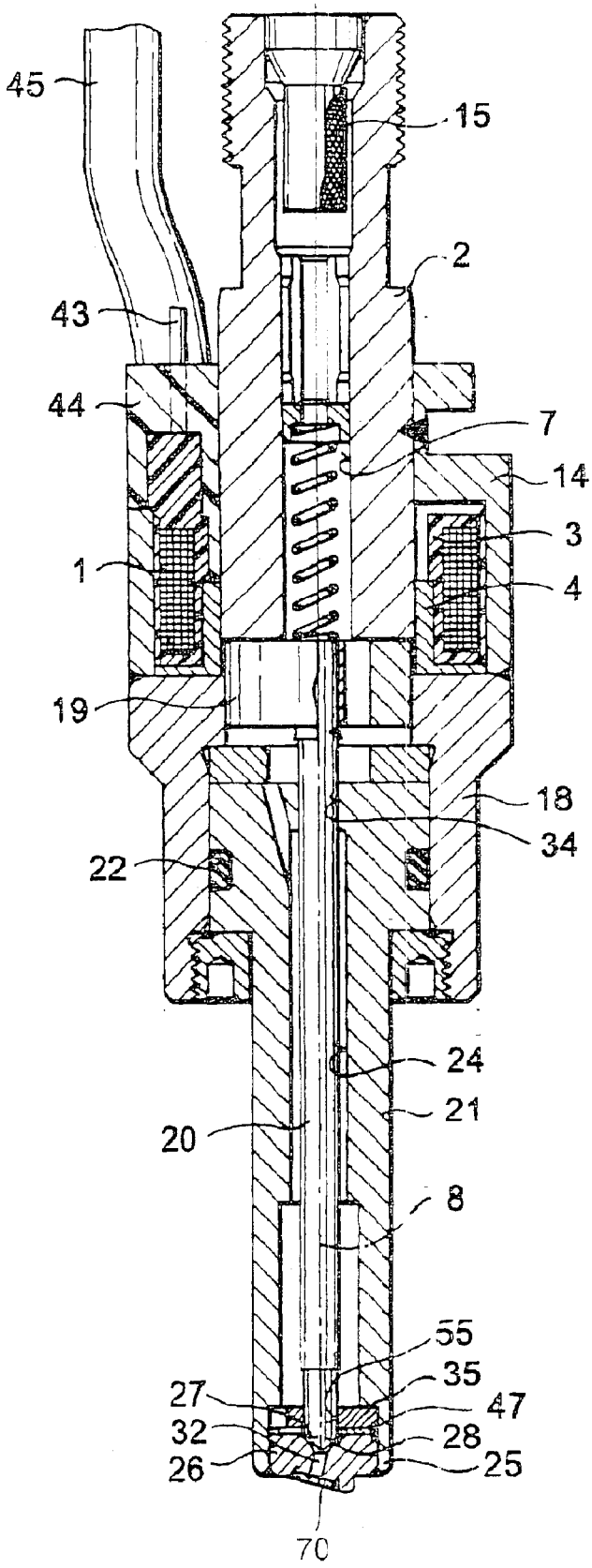
FIG. 1 shows a first embodiment of a fuel injector according to the present invention.

The valve, which is illustrated as an exemplary embodiment in FIG. 1 as an electromagnetically actuatable injector for fuel injection systems in spark ignition internal combustion engines, has a tubular, substantially hollow cylindrical core 2 which is at least partially enclosed by a solenoid 1 and which acts as an internal pole of a magnetic circuit. The fuel injector is particularly suitable as a high-pressure injector for direct spray discharge of fuel into a combustion chamber of an internal combustion engine. A bobbin 3 made of plastic, which has a stepped design, for example, accommodates a winding of solenoid 1 and, in conjunction with core 2 and an annular, nonmagnetic intermediate part 4 having an L-shaped cross section which is partially enclosed by solenoid 1, allows a particularly compact and short design of the injector in the region of solenoid 1.

A pass-through longitudinal orifice 7 is provided in core 2 which extends along a longitudinal valve axis 8. Core 2 of the magnetic circuit also serves as a fuel inlet connector, and longitudinal orifice 7 acts as a fuel supply duct. Above solenoid 1, core 2 is firmly attached to outer metallic (ferritic, for example) housing part 14, which, as a stationary pole or external guide element, closes the magnetic circuit and completely encloses solenoid 1, at least in the circumferential direction. A fuel filter 15 is provided on the inflow side in longitudinal orifice 7 of core 2 for filtering out fuel components which because of their size could cause blockage or damage in the injector. Fuel filter 15 is attached by pressing it into core 2, for example.

Core 2 together with housing part 14 forms the inflow-side end of the fuel injector. The upper housing part 14 extends just over solenoid 1. A lower tubular housing part 18 is tightly and permanently joined to upper housing part 14 and encloses or accommodates for example an axially movable valve part having an armature 19, a rod-shaped valve needle 20, and an elongated valve seat support 21. Both housing parts 14 and 18 are permanently joined together by a circumferential weld, for example.

In the embodiment illustrated in FIG. 1, lower housing part 18 and substantially tubular valve seat support 21 are permanently connected to one another by screwing, although welding, soldering, or bordering are also possible joining methods. A seal between housing part 18 and valve seat support 21 is created by a sealing ring 22, for example. Valve seat support 21 has an internal through orifice 24 through its entire axial extension which runs concentrically with respect to longitudinal valve axis 8.

At its lower end 25, valve seat support 21 encloses a disk-shaped valve seat element 26 which is fitted into through orifice 24 and which has valve seat face 27 tapering in the downstream direction in the shape of a truncated cone, for example. Valve needle 20, which may be rod-shaped and has a substantially circular cross section, is situated in through orifice 24 and has a valve closing section 28 on its downstream end. This valve closing section 28, which for example has a spherical, partially spherical, or rounded shape, or which is conically tapered, cooperates with valve seat face 27 provided in valve seat element 26. Downstream from valve seat face 27 at least one outlet orifice 32 for the fuel is provided in valve seat element 26.

The injector may be actuated by electromagnetic means, for example. However, a piezoelectric actuator may also be used as an energizable actuator. In addition, actuation via a piston under controlled pressure load is possible. The electromagnetic circuit, which has solenoid 1, core 2, housing parts 14, and 18, and armature 19, is used to axially move valve needle 20 and thus to open the injector against the elastic force of a restoring spring 33 situated in longitudinal orifice 7 of core 2, and also for closing the injector. Armature 19 is connected to the end of valve needle 20 facing away from valve closing section 28 by a weld and is aligned with core 2. In order to guide valve needle 20 during its axial movement together with armature 19 along longitudinal valve axis 8, a guide orifice 34 is provided in valve seat support 21 on the end facing toward armature 19, and a disk-shaped guide element 35 having a dimensionally accurate guide orifice 55 is provided upstream from valve seat element 26. When moving in the axial direction, armature 19 is enclosed by intermediate part 4.

A swirl element 47 is situated between guide element 35 and valve seat element 26, so that all three elements 35, 47, and 26 are situated one directly on top of the other and are accommodated in valve seat support 21. The three disk-shaped elements 35, 47, and 26 are tightly connected to one another with a material fit (weld spots or welds 60 in FIGS. 2 and 3).

The lift of valve needle 20 is delimited by the installation position of valve seat element 26. When solenoid 1 is not energized, one end position of valve needle 20 is delimited by the contact of valve closing section 28 with valve seat face 27, and when solenoid 1 is energized, the other end position of valve needle 20 is delimited by the contact of armature 19 with the downstream end face of core 2. The surfaces of the components in the latter stop region are chrome-plated, for example.

Solenoid 1 is electrically contacted and thus energized via contact elements 43 which are provided with a plastic extrusion coating 44 on the outside of bobbin 3. Plastic extrusion coating 44 may also extend over additional components (housing parts 14 and 18, for example) of the fuel injector. An electrical connecting cable 45 running out of plastic extrusion coating 44 supplies power to solenoid 1.

Figure 2:
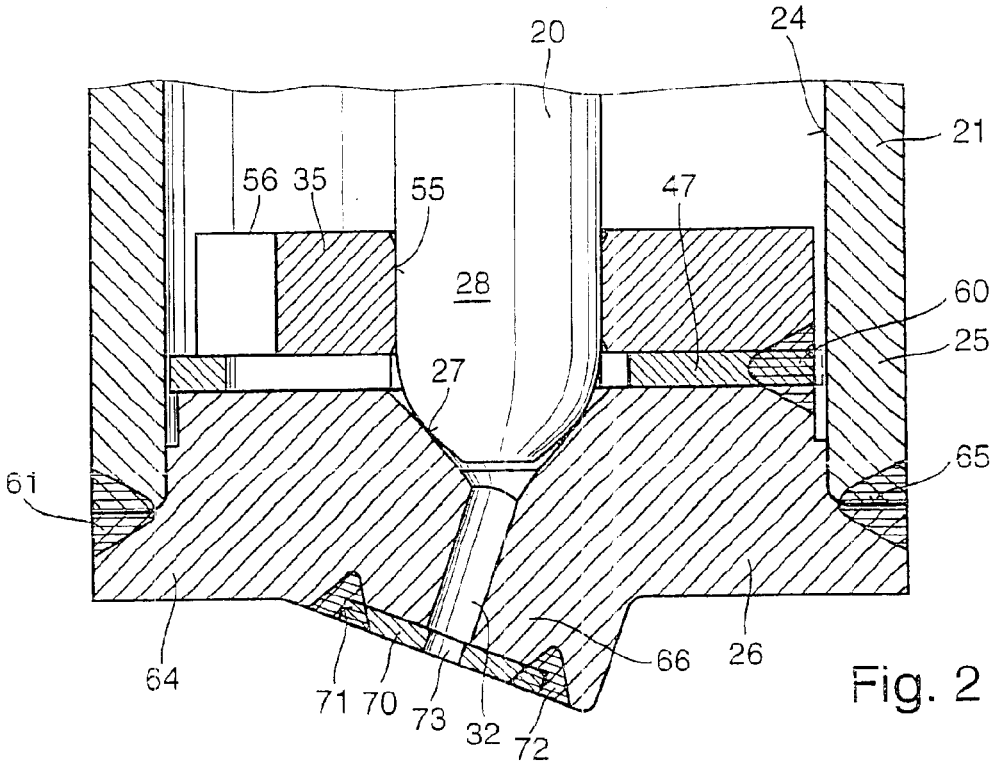
FIG. 2 shows a downstream valve end of a second embodiment of a fuel injector according to the present invention.

FIG. 2 shows a second embodiment of a fuel injector, of which only the downstream valve end is illustrated. Guide element 35 has a dimensionally accurate inner guide orifice 55 through which valve needle 20 moves during its axial motion. From the outer periphery inward, guide element 35 has multiple recesses 56 which are distributed over the periphery, thereby ensuring fuel flow along the outer periphery of guide element 35 into swirl element 47 and continuing in the direction of valve seat face 27.

In the example embodiment shown in FIG. 2, valve seat element 26 has a circumferential flange 64 which engages from below with downstream end 25 of valve seat support 21. Upper side 65 of circumferential flange 64 is ground while clamped together with guide orifice 55 and valve seat face 27. The three-disk valve body including elements 35, 47, and 26 is inserted until upper side 65 of flange 64 contacts end 25 of valve seat support 21. The valve body is attached for example by a weld 61 produced by a laser in the contact region of both components 21 and 26. Outlet orifice 32 is provided at an inclined angle, for example, with respect to longitudinal valve axis 8 and ends downstream in a protruding spray discharge region 66.

A thin perforated disk 70 having a specific orifice structure is provided in spray discharge region 66 of valve seat element 26. This perforated disk 70, which for example is countersunk into an indentation 71 in spray discharge region 66 in valve seat element 26 on its downstream front face and meets flush with this front face, functions primarily as a flow restrictor. The steady-state flow rate is adjusted via the size of orifice 73. Inner orifice 73 in perforated disk 70 has a smaller orifice diameter than does outlet orifice 32 in valve seat element 26. Perforated disk 70 is attached to valve seat element 26 by a weld 72 (as shown), or attachment using a retaining ring may also be utilized. Perforated disk 70 is installed, for example, with the normal to its surface at a non-90-degree angle with respect to longitudinal valve axis 8, so that the angle of inclination of outlet orifice 32 with respect to longitudinal valve axis 8 corresponds to orifice 73 in tilted perforated disk 70. In this manner the longitudinal axes of outlet orifice 32 and orifice 73 coincide, and outlet orifice 32 and orifice 73 are put into alignment. The length of tubular outlet orifice 32 provided in valve seat element 26 is greater than the entire length of orifice 73 in perforated disk 70, the lengths having a ratio for example of between 3 and 10 to 1; in the illustrated embodiment, they have a ratio of approximately 5 to 1.

Figure 3:
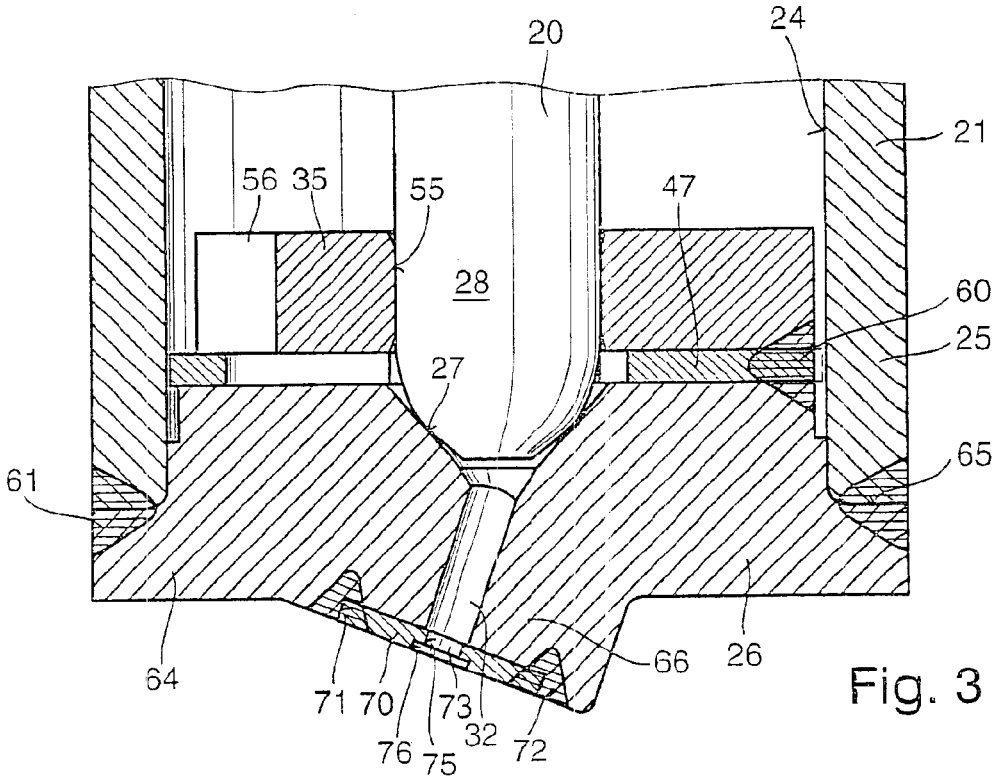
FIG. 3 shows a downstream valve end of a third embodiment of a fuel injector according to the present invention.

In the example embodiment shown in FIG. 2, orifice 73 has a continuously cylindrical shape, whereas in the embodiment according to FIG. 3 a stepped orifice 73 is provided. Orifice 73 in perforated disk 70 according to FIG. 3 has a narrower upstream section 75 and a wider downstream section 76. At least the narrower section 75 has a smaller orifice diameter than outlet orifice 32 of valve seat element 26. While narrower section 75 of orifice 73 determines the steady-state flow rate, slightly enlarged section 76 may influence the spray angle of the spray-discharged fuel as well.

Perforated disks 70 having simple and yet widely differing orifice structures may be manufactured on a large scale very easily and in a precisely reproducible manner. Since, in the perforated disks 70 according to the present invention, the flow-determining orifice cross section is provided with a flow restrictor function, it is advantageous that no high demands are placed on the dimensional accuracy of outlet orifice 32 in valve seat element 26 downstream from valve seat face 27. Valve seat element 26 is therefore considerably easier to handle during manufacturing and processing.

Perforated disks 70 can be manufactured by metal electrodeposition, in particular by multilayer metal plating. While the perforated disk 70 according to FIG. 2 is formed from a single metal layer, the embodiment according to FIG. 3 shows a perforated disk 70 having two layers, each layer being characterized by a respective constant internal orifice contour 75, 76 which is altered in the next layer. A double-layer perforated disk 70 may be produced, for example, by electrodeposition of two layers one on top of the other, both layers then being adhesively bonded to one another and ultimately forming a component. Using this technology, it is possible to create shapes of orifices 73 in perforated disks 70 which depart from a circular contour, such as triangular to n-sided or cloverleaf shapes or the like. Highly differing jet shapes may thus be easily created using a perforated disk 70 having such a design.

Using deep lithographic electroplating methods, the following features in the contouring may be realized:

Layers having constant thickness over the disk surface,

As a result of the deep lithographic structuring, substantially vertical indentations in the layers which form the respective cavities having flow-through (due to the manufacturing process, deviations of approximately 3° in relation to optimally vertical walls may be present), Desired undercuts and overlaps of the indentations due to the multilayer construction of individually structured metal layers, Indentations having any cross-sectional shapes which are essentially parallel to the axis, and One-piece design of the perforated disk, since the individual metal depositions directly follow one another in succession.

It is also possible to manufacture perforated disks 70 using stamping, embossing, erosion, or etching techniques. Thus, the orifice contour may also be provided in a very precise manner using laser beam drilling, erosion, or stamping techniques.

What is claimed is:

1. A fuel injector for a fuel injection system of an internal combustion engine, the fuel injector having a longitudinal valve axis, comprising:

an actuator;

a valve seat element including a stationary valve seat and an outlet orifice downstream from the stationary valve seat;

a valve needle movable by the actuator and cooperating with the stationary valve seat to open and close the fuel injector;

a swirl element situated upstream from the stationary valve seat; and a perforated disk attached to the valve seat element including an aligned orifice;

wherein the outlet orifice opens directly into the aligned orifice in the perforated disk, a length of the outlet orifice in the valve seat element in a direction of flow being greater than a length of the aligned orifice in the perforated disk, and a width of the outlet orifice being greater than a narrowest width of the aligned orifice, and wherein the outlet orifice is inclined with respect to a longitudinal valve axis.

2. The fuel injector of claim 1, wherein the aligned orifice in the perforated disk has a constant width over its entire length.

3. The fuel injector of claim 1, wherein the aligned orifice in the perforated disk is stepped, and has a variable width over its length.

4. The fuel injector of claim 3, wherein the narrowest width of the aligned orifice in the perforated disk faces toward the outlet orifice, and the aligned orifice has a larger width in the downstream direction.

5. The fuel injector of claim 1, wherein a steady-state flow rate of the injector may be adjusted via the narrowest width of the aligned orifice.

6. The fuel injector of claim 1, wherein the perforated disk is attached to the valve seat element and includes a surface having a normal that points at a non-90-degree angle with respect to the longitudinal valve axis.

7. The fuel injector of claim 1, wherein the valve seat element includes a downstream front face having an indentation into which the perforated disk is inserted.

8. The fuel injector of claim 7, wherein the perforated disk is inserted into the indentation and ends flush with the downstream front face of the valve seat element.

9. The fuel injector of claim 1, wherein the perforated disk is formed by metal electro-deposition.

* * * * *